US005258683A

United States Patent [19]

Eggink et al.

[11] Patent Number: 5,258,683

[45] Date of Patent: Nov. 2, 1993

[54] ELECTRODELESS LOW-PRESSURE DISCHARGE LAMP

[75] Inventors: Hendrik J. Eggink; Winand H. A. M. Friederichs, both of Eindhoven, Netherlands

[73] Assignee: U.S. Philips Corporation, New York, N.Y.

[21] Appl. No.: 818,195

[22] Filed: Jan. 8, 1992

[30] Foreign Application Priority Data

Jan. 25, 1991 [NL] Netherlands ..... 9100125

[51] Int. Cl.[5] ..... H01J 1/50

[52] U.S. Cl. ..... 313/35; 313/161; 313/34; 313/45; 313/46; 315/248

[58] Field of Search ..... 313/34, 35, 42, 45, 313/46, 161; 315/248

[56] References Cited

U.S. PATENT DOCUMENTS 3,138,739 6/1964 Farmer ..... 313/34
4,792,725 12/1988 Levy et al. .
4,927,217 5/1990 Kroes et al. .
5,006,752 4/1991 Eggink et al. ..... 315/248

FOREIGN PATENT DOCUMENTS 0357453 9/1989 European Pat. Off. .
6004487 1/1979 Japan ..... 315/248

*Primary Examiner*—Donald J. Yusko
*Assistant Examiner*—N. D. Patel
*Attorney, Agent, or Firm*—Brian J. Wieghaus

[57] ABSTRACT

The electrodeless low pressure discharge lamp has a lamp vessel (1) having a cavity (3) at an end portion (2) thereof. An electric coil (4) surrounding a plastic tube (5), wherein a liquid filled tubular container (7) surrounded by a soft-magnetic core (6) is present, is accommodated in the cavity (3). The tubular container (7) is at a portion outside the cavity (3) rigidly secured in a recess (82) present in a protrusion (81) present at a flange (8). A mounting member (9) bearing the plastic tube (5) and the lamp vessel (1) is securable to the flange (8).

25 Claims, 3 Drawing Sheets

ELECTRODELESS LOW-PRESSURE DISCHARGE LAMP

CROSS-REFERENCE TO RELATED APPLICATIONS

This application relates to U.S. application Ser. No. 818,003 entitled "Electrodeless Low-Pressure Discharge Lamp" of Henrik J. Eggink, Winand H. A. M. Friederichs and Nacasius G. T. Van Gennip which discloses and claims an electrodeless mercury vapor discharge lamp having a sleeve surrounding a magnetic core and filled with an elastic polymer, and to U.S. application Ser. No. 818,005, now U.S. Pat. No. 5,211,472 of Winand Hendrik Friederichs and Nicasius G. T. Van Gennip which discloses and claims a low pressure mercury vapor discharge lamp having a mounting member which permits removal of the lamp from its support, both of which were filed simultaneously herewith.

BACKGROUND OF THE INVENTION

The invention relates to an electrodeless low-pressure discharge lamp comprising a lamp vessel which is sealed in a vacuumtight manner, contains ionizable metal vapour and rare gas, and has a cavity at an end portion of said vessel, an electric coil around a sleeve of synthetic material in the cavity of the lamp vessel, a tube containing a liquid in the core of soft magnetic material, which tube projects to outside the cavity and has a flange there, a mounting member which is connected to the sleeve of synthetic material and the lamp vessel and can be fastened against the flange.

Such an electrodeless lamp is known from EP-0 384 520, which corresponds to U.S. Pat. No. 5,006,752.

It is important for the operation of the lamp that the core of soft magnetic material is cooled because its specific magnetic losses increase with increasing temperature and the magnetic permeability starts to decrease at a raised temperature.

The tube containing liquid transfers heat from the core to the flange, while the flange is to transfer heat to its surroundings. Part of these surroundings is formed by a wall, for example of a luminaire, against which the flange of an installed lamp is fastened.

It has been found that a satisfactory cooling of the core in the known lamp is insufficiently safeguarded.

SUMMARY OF THE INVENTION

The invention has for its object to provide an electrodeless lamp of the kind described in the opening paragraph which is of a simple construction and which has an improved cooling of the core.

According to the invention, this object is achieved in that the flange has a projection with a cavity in which the tube is securely fixed.

In contrast to the known lamp, in which the flange is a flat disc and the tube is in contact with the flange only over a length equal to the thickness of said disc; the lamp according to the invention has a flange with a projection in which the tube is enclosed. As a result the tube is held in the flange over a greater length and accordingly has a better heat contact with the flange.

In a favourable embodiment, the projection has a tapering foot. An advantage of this is a wide contact area with the flange itself, and thus a better heat transfer to the flange itself, than in the case of a narrow, for example, cylindrical projection. On the other hand, such a tapering foot has a smaller weight than a cylindrical foot having the same diameter at the base. Another advantage of a tapering foot is a greater rigidity of the flange and thus a greater capability of retaining its shape. This capability is important for a good contact with a wall against which the lamp with its flange is to be mounted.

The known lamp is mounted against a wall with the mounting member and the flange at the tube on either side of this wall. This implies that the lamp is not fully assembled until the moment it is mounted against said wall.

In a favourable embodiment, the flange of the tube is fastened directly to the mounting member. This embodiment simplifies mounting of the lamp to a wall, for example, of a luminaire. It is attractive to provide the flange with threaded holes for this purpose, so that the flange can be tightened against such a wall with screws and gets a good thermal contact with it.

In the known lamp, the tube projects through the flange as well as through a wall against which the lamp is mounted. The opening to be made for this purpose in the wall reduces the contact area of this wall with the flange.

In an embodiment, the projection at the flange is accommodated in the mounting member and the flange has a flat surface facing away from the lamp vessel. In this embodiment, the fully assembled lamp may have a flat support surface, which is convenient for mounting in a luminaire. The tube is furthermore protected against damage since it does not project, and the lamp in this embodiment has a small overall length.

To prevent the creation of a galvanic element upon mounting of the flange against a wall of a different metal, an electric insulator may be provided against the flange, for example, a silicone foil. Means for fastening the flange to the mounting member may also be covered by this.

To protect the tube containing liquid, the sleeve of synthetic material in an embodiment of the lamp bears a ring having elastic spokes which bear laterally on the tube and also keep the core fixed in the tube.

The tube containing liquid may be made of metal, for example copper, because of its good thermal conductivity. The flange may be made of, for example, the same material, or, in the case of a copper tube, of brass, for example $CuZn_{15}$. This material can be easily cast and machined, for example ground, in order to obtain a flange having a flat surface.

The tube may be present in the flange with tight fit. Alternatively, a fastening with, for example, solder or cement, such as, for example, silicone compound, is possible. The tube may also be mounted by clamping, for example, in that two parts of a flange are pressed against one another with the tube interposed between them.

BRIEF DESCRIPTION OF THE DRAWING

This and other aspects of the electrodeless low-pressure discharge lamp according to the invention are shown in the drawings, in which.

DESCRIPTION OF THE PREFERRED EMBODIMENTS

Figure 1:
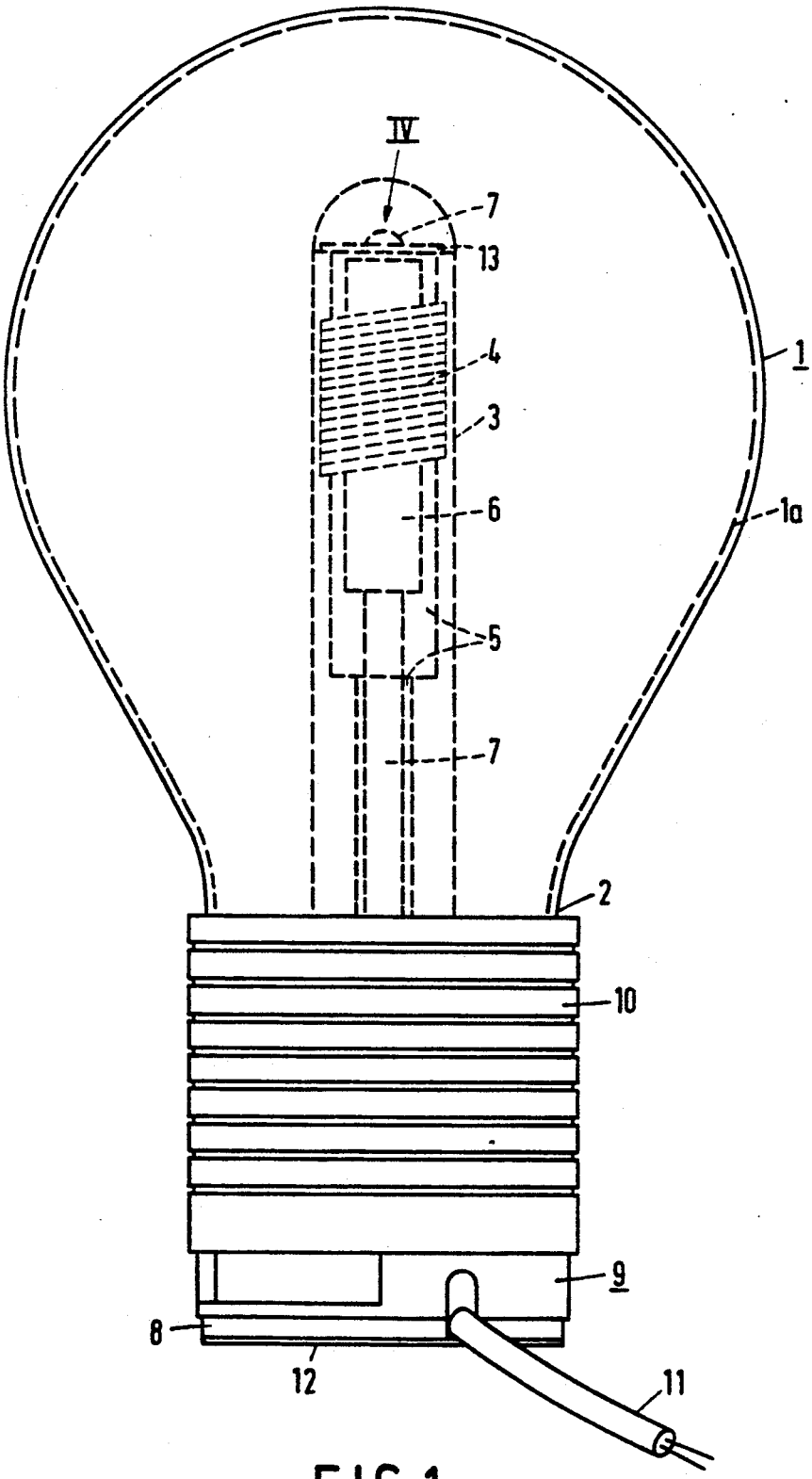
FIG. 1 is a side elevation of an embodiment of the lamp.

In FIG. 1, the lamp has a lamp vessel 1 which is sealed in a vacuumtight manner and is made of, for example, lime glass, with a cavity 3 made of, for example, lead glass at an end portion 2. The lamp vessel 1 is filled with an ionizable metal vapour and rare gas. The lamp drawn contains mercury vapour and has a luminescent coating 1*a* on the lamp vessel.

An electric coil 4 around a sleeve 5 of synthetic material is inside the cavity 3. In the sleeve 5, there is a core 6 of soft magnetic material, for example Philips 4C6, into which a thermal conductor such as tube 7 containing a liquid, for example water, is passed, which tube projects to outside the cavity 3 and has a flange 8 there. The liquid containing tube 13 and flange comprise a cooling means for cooling the core 6.

A mounting member 9 is connected to the sleeve 5 of synthetic material and to the lamp vessel 1, in the Figure by means of a collar 10. The mounting member 9 can be fastened against the flange 8.

A cable 11 connected to the coil 4 issues to the exterior for connection to a supply source. An electric insulator 12 covers the flange surface facing away from the lamp vessel 1. The sleeve 5 bears a ring 13.

Figure 2:
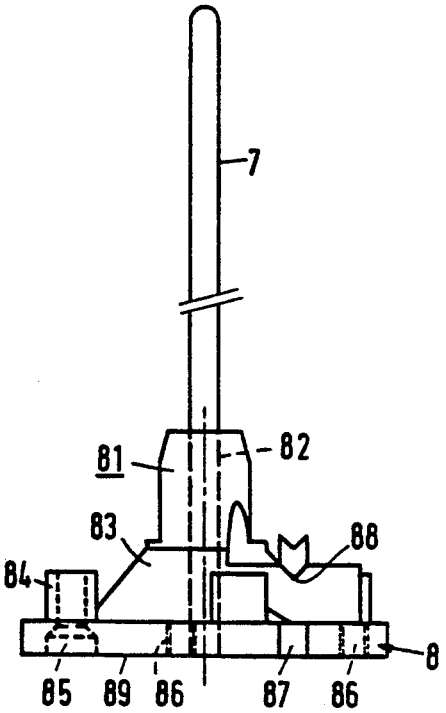
FIG. 2 is a side elevation of the flange of FIG. 1.

In FIG. 2, the flange 8 has a projection 81 having a recess 82 in which the tube 7 is securely fixed, for example, with solder. The projection 81 has a tapering foot 83. The flange is provided with holes 84 so that it can be fastened to the mounting member with screws, whose heads may be accommodated in chambers 85. The flange has threaded holes 86 for being mounted against a wall, for example, of a luminaire.

Figure 5:
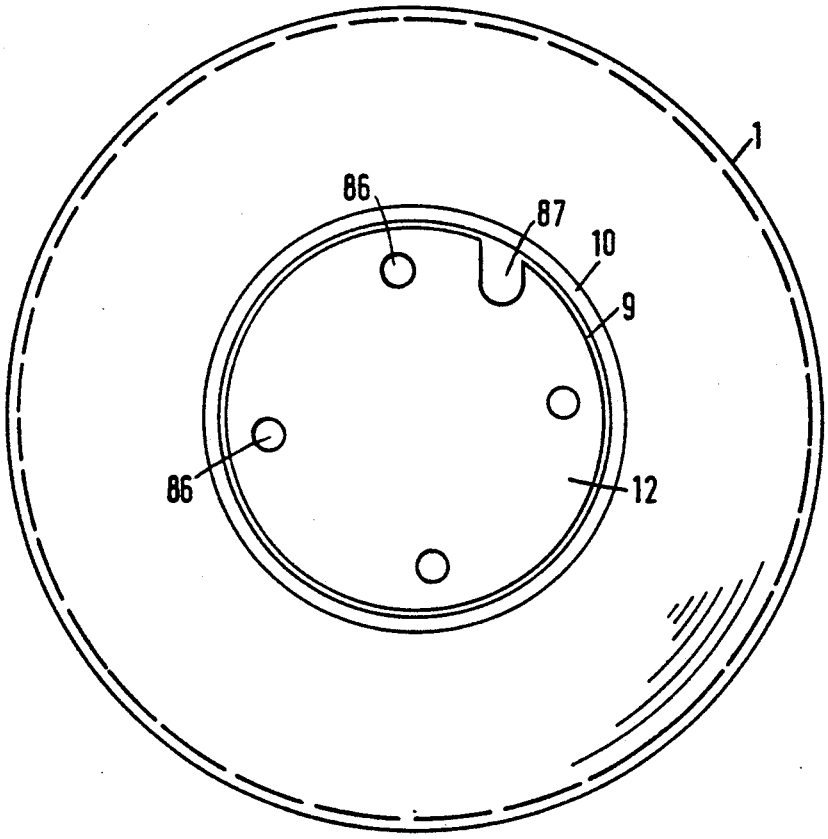
FIG. 5 is a bottom view of the lamp in FIG. 1.

A port 87 renders it possible for a cable 11 (FIG. 1) to issue in transversal or longitudinal direction. This cable may be clamped in an anchorage 88 in order to eliminate tensional forces on its connection to the coil 4 (FIG. 1). The flange 8 has a flat surface 89 facing away from the lamp vessel 1 (FIG. 2, 3) and covered with an electric insulator 12 (FIG. 5), which leaves the holes 86, but not the holes 84 free.

Figure 3:
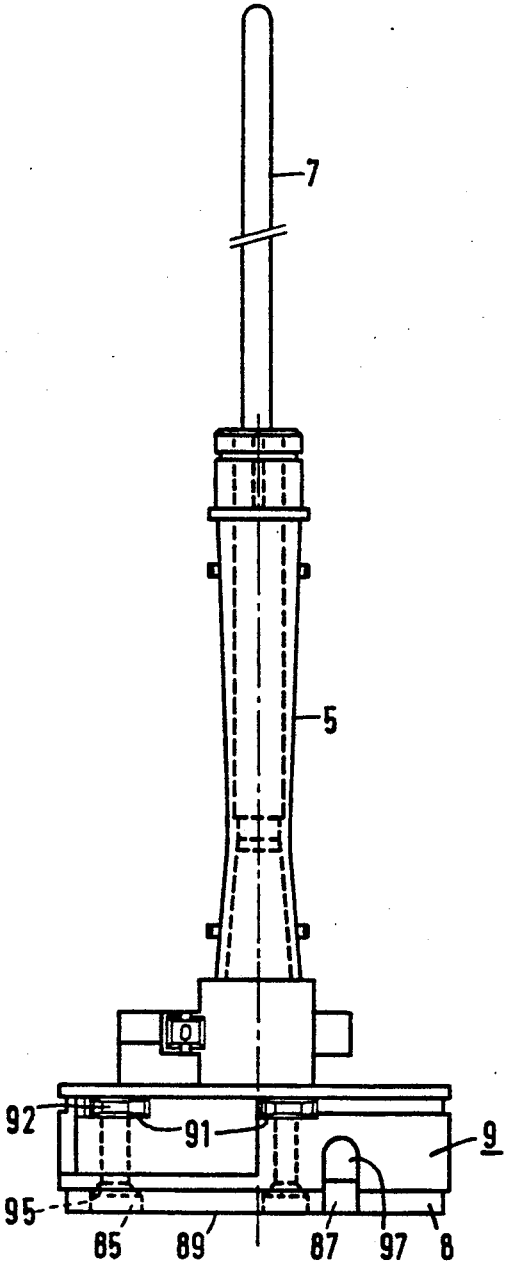
FIG. 3 is a side elevation of the mounting member of FIG. 1 with a flange fastened to it.

In FIG. 3, the flange 8 is fastened directly against the mounting member 9 The mounting member 9 has chambers 91 which are accessible from outside and in which nuts 92 are inserted. Screws 93 with their heads countersunk in the chambers 85 are screwed into the nuts 92, keeping the flange 8 tightened against the mounting member 9. The mounting member 9 has an opening in line with with the port 87 for the lateral exit of a cable 11 (FIG. 1). The unit shown has a flat support surface 89. The projection 81 (FIG. 2) is accommodated in the mounting member 9.

Figure 4:
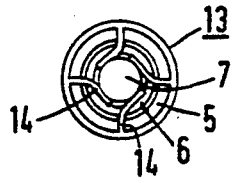
FIG. 4 is a view taken on the line IV in FIG. 1.

In FIG. 4, the ring 13 has bent spokes 14 which bear laterally on the tube 7 and also keep the core 6 fixed in the sleeve 5. The ring 13 is joined to the sleeve 5 with a snap connection and supported thereby.

We claim:

1. An electrodeless low-pressure discharge lamp comprising a lamp vessel which is sealed in a vacuum-tight manner, contains ionizable metal vapour and rare gas, and has a cavity at an end portion of said lamp vessel, a sleeve of synthetic material arranged in the lamp vessel cavity, an electric core arranged about said sleeve, a core of soft magnetic material within said sleeve, a tube containing a liquid, said tube being disposed within said core of soft magnetic material, which tube projects to outside the cavity and has a flange outside the cavity, a mounting member which is connected to said sleeve and said lamp vessel and can be fastened against said tube flange, characterized in that:

said flange has a projection with a recess in which said tube is securely fixed.

2. An electrodeless low-pressure discharge lamp as claimed in claim 1, characterized in that the projection has a tapering foot.

3. An electrodeless low-pressure discharge lamp as claimed in claim 2, characterized in that the flange is fastened directly to the mounting member.

4. An electrodeless low-pressure discharge lamp as claimed in claim 3, characterized in that the flange is includes threaded holes for mounting against a wall.

5. An electrodeless low-pressure discharge lamp as claimed in claim 4, characterized in that the projection is accommodated in the mounting member.

6. An electrodeless low-pressure discharge lamp as claimed in claim 5, characterized in that the flange has a flat surface facing away from the lamp vessel.

7. An electrodeless low-pressure discharge lamp as claimed in claim 6, characterized in that the flange has a flat surface facing away from the lamp vessel and covered with an electric insulator.

8. An electrodeless low-pressure discharge lamp as claimed in claim 7, characterized in that only the threaded holes for wall mounting are left uncovered by the electric insulator.

9. An electrodeless low-pressure discharge lamp as claimed in claim 6, characterized in that the sleeve of synthetic material bears a ring having elastic spokes which bear laterally on the tube.

10. An electrodeless low-pressure discharge lamp as claimed in claim 9, characterized in that the spokes keep the core (6) fixed in the sleeve.

11. An electrodeless low-pressure discharge lamp as claimed in claim 3, characterized in that the sleeve of synthetic material bears a ring having elastic spokes which bear laterally on the tube.

12. An electrodeless low-pressure discharge lamp as claimed in claim 1, characterized in that the sleeve of synthetic material bears a ring having elastic spokes which bear laterally on the tube.

13. An electrodeless low-pressure discharge lamp as claimed in claim 3, characterized in that the projection is accommodated in the mounting member.

14. An electrodeless low-pressure discharge lamp as claimed in claim 13, characterized in that the flange has a flat surface facing away from the lamp vessel.

15. An electrodeless low-pressure discharge lamp as claimed in claim 13, characterized in that the flange has a flat surface facing away from the lamp vessel and covered with an electric insulator.

16. An electrodeless low-pressure discharge lamp as claimed in claim 13, characterized in that only the threaded holes for wall mounting are left uncovered by the electric insulator.

17. An electrodeless low-pressure discharge lamp as claimed in claim 1, characterized in that the flange is fastened directly to the mounting member.

18. An electrodeless low-pressure discharge lamp as claimed in claim 17, characterized in that the flange is provided with threaded holes for mounting against a wall.

19. An electrodeless low-pressure discharge lamp as claimed in claim 18, characterized in that the projection is accommodated in the mounting member.

20. An electrodeless low-pressure discharge lamp as claimed in claim 19, characterized in that the flange has a flat surface facing away from the lamp vessel.

21. An electrodeless low-pressure discharge lamp as claimed in claim 20, characterized in that the flange has a flat surface facing away from the lamp vessel and covered with an electric insulator.

22. An electrodeless low-pressure discharge lamp as claimed in claim 21, characterized in that only the threaded holes for wall mounting are left uncovered by the electric insulator.

23. An electrodeless low-pressure discharge lamp as claimed in claim 17, characterized in that the flange is fastened directly to the mounting member.

24. An electrodeless low-pressure discharge lamp, comprising:

a lamp vessel sealed in a vacuum-tight manner, containing a discharge sustaining fill, and having an inwardly extending protrusion which defines a cavity within said lamp vessel;

means including a magnetic core and a coil disposed within said cavity for exciting said discharge sustaining fill to emit light; and cooling means for conducting heat away from said magnetic core, said cooling means comprising a thermal conductor arranged within said cavity and a flange having a projection with an elongate recess in which said thermal conductor is securely fixed along a major portion of the length of said recess, whereby heat transfer from said thermal conductor to said flange occurs along said major portion of said recess.

25. A low pressure mercury vapor discharge lamp according to claim 24, wherein said thermal conductor is a sealed tube containing a liquid.

* * * * *